United States Patent [19]

Check, Jr.

[11] Patent Number: 4,471,440

[45] Date of Patent: Sep. 11, 1984

[54] ELECTRONIC POSTAGE METER HAVING POWER MAGNETICALLY COUPLED TO THE METER FROM THE METER BASE

[75] Inventor: Frank T. Check, Jr., Orange, Conn.

[73] Assignee: Pitney Bowes Inc., Stamford, Conn.

[21] Appl. No.: 344,651

[22] Filed: Feb. 1, 1982

[51] Int. Cl.[3] ..... G07B 17/01

[52] U.S. Cl. ..... 364/466; 364/567; 364/480; 323/355

[58] Field of Search ..... 323/355; 336/77, 115; 364/466; 365/94, 130; 336/126, 44, 182; 324/234, 236, 235, 243

[56] References Cited

U.S. PATENT DOCUMENTS

| | | | |
|---|---|---|---|
| 2,934,009 | 4/1960 | Bach et al. | 101/235 |
| 3,764,971 | 10/1973 | Brobeck | 336/115 |
| 3,938,095 | 2/1976 | Check, Jr. et al. | 340/172.5 |
| 3,978,457 | 8/1976 | Check, Jr. et al. | 340/172.5 |
| 4,301,507 | 11/1981 | Soderberg et al. | 364/464 |
| 4,310,754 | 1/1982 | Check, Jr. | 235/454 |
| 4,310,755 | 1/1982 | Miller | 250/214 R |

OTHER PUBLICATIONS

European Patent Application #8040060309 filed 05/05/1980 by Everett Jr. et al.

*Primary Examiner*—Edward J. Wise
*Assistant Examiner*—Dale M. Shaw
*Attorney, Agent, or Firm*—David E. Pitchenik; William D. Soltow, Jr.; Albert W. Scribner

[57] ABSTRACT

A postage meter includes a printer adapted to print postage and a computer coupled to the printer to account for postage printed by the printer. A power supply is coupled to the computer for energizing the computer to operate. The power supply includes a winding adapted to energize the power supply when magnetic flux is caused to pass through the winding. The power supply further includes a magnetic circuit for coupling magnetic flux to the winding. A housing encloses the postage meter power supply, postage meter computer and postage meter printer. The housing includes a portion adapted to allow the passage of magnetic energy into the interior thereof to energize the magnetic circuit.

The postage meter may operate in conjunction with a mailing machine. The mailing machine is adapted to engage the postage meter and includes a power supply system which energizes the mailing machine. The power supply generates magnetic energy and a magnetic circuit cooperates with the power supply to couple the magnetic energy such that when the postage meter is mounted on the mailing machine the magnetic energy will enter the postage meter.

The postage meter is of the type which includes a non-volatile memory coupled to the postage meter computer. The non-volatile memory includes a plurality of locations for storing accounting data when said postage meter computer is not energized. The plurality of locations are in predetermined physical locations which are physically assessible. The locations are positioned in the memory so that they can be inspected to determine the orientation of bit patterns therein without electrically energizing the non-volatile memory or physically altering the memory structure.

9 Claims, 3 Drawing Figures

ELECTRONIC POSTAGE METER HAVING POWER MAGNETICALLY COUPLED TO THE METER FROM THE METER BASE

FIELD OF INVENTION

The present invention relates to electronic postage meters, and particularly, to electronic postage meters having energy magnetically coupled into a sealed meter unit.

BACKGROUND OF THE INVENTION

Electronic postage meter systems have been developed, for example, the systems disclosed in U.S. Pat. No. 3,978,457 for MICROCOMPUTERIZED ELECTRONIC POSTAGE METER SYSTEMS, in U.S. Pat. No. 3,938,095 for COMPUTER RESPONSIVE POSTAGE METER, in U.S. Pat. No. 4,301,507 for ELECTRONIC POSTAGE METER HAVING PLURAL COMPUTING SYSTEMS, and in European Patent Application, publication No. 0 019 515 for ELECTRONIC POSTAGE METER HAVING IMPROVED SECURITY AND FAULT TOLERANCE FEATURES.

Each of the above electronic postage meters involves computing mechanisms which are physically sealed within tamper proof enclosures. This is because postage meters are adapted to print postage which have monetary value and both physical and electrical security must be provided to avoid tampering. As a result, a problem exist in energizing the electronic circuits of the meter within the secure postage meter housing in a way which will avoid intentional or inadvertent electrical damage or electromagnetic damage to the meter.

The electronic postage meters include non-volatile memory for storing critical information when power is not applied to the meter. Various types of accounting information may be stored in the meters non-volatile memory. This information includes, for example, the total amount of postage remaining in the meter for subsequent printing and the total amount of postage printed by the meter. Other types of accounting or operating data may also be stored in the non-volatile memory. Memory functions in the electronic postage meters have replaced the functions served in previous mechanical postage meters by mechanical accounting registers. These non-volatile memories, as well as volatile memories and other circuitry within the meter are susceptible to electromagnetic radiation and electrical transients which could either destroy information or cause erronious information to be generated. This can result in a loss of funds to the user. Accordingly, it has been recognized that various types of protection must be provided to avoid such undesirable results.

SUMMARY OF THE INVENTION

It has been discovered that an electronic postage meter can be energized by utilizing magnetic energy generated in the postage meter base and magneticaly coupled into a sealed meter unit. This eliminates all direct electrical connections into the meter.

By utilizing magnetic coupling into the meter it has been discovered that there is less chance for damage to the internal components of the meter from line spikes on the AC power energizing the system. By energizing the meter with magnetic coupling, the meter unit itself can be better sealed in the physical sense, with no openings for electrical connections. Information can be communicated between the postage meter mailing machine and the postage meter sealed unit by means of optical fiber techniques.

In accordance with a feature of the invention, the magnetic circuit designed to energize the postage meter unit are designed to limit the amount of energy which can be coupled from the base of the meter into the meter unit. Additionally, in accordance with another feature of the present invention, the meter may be powered by magnetic energy which alternates at a rate significantly higher then typical AC line rates of 60 and 50 hertz. The utilization of high frequency electromagnetic energy allows a reduction in the size of the magnetic circuitry.

The postage meter is of the type which includes a non-volatile memory coupled to the postage meter computer. The non-volatile memory includes a plurality of locations for storing accounting data when said postage meter computer is not energized. The plurality of locations are in predetermined physical locations which are physically accessable when the memory is removed from the meter so that the locations can be scanned by a scanning device to determine the orientation of bit patterns therein without energizing the non-volatile memory and without physically altering the non-volatile memory structure.

BRIEF DESCRIPTION OF THE DRAWINGS

Reference is now made to the drawings wherein like reference numerals designate similar elements in the various views.

DETAILED DESCRIPTION

Figure 1:
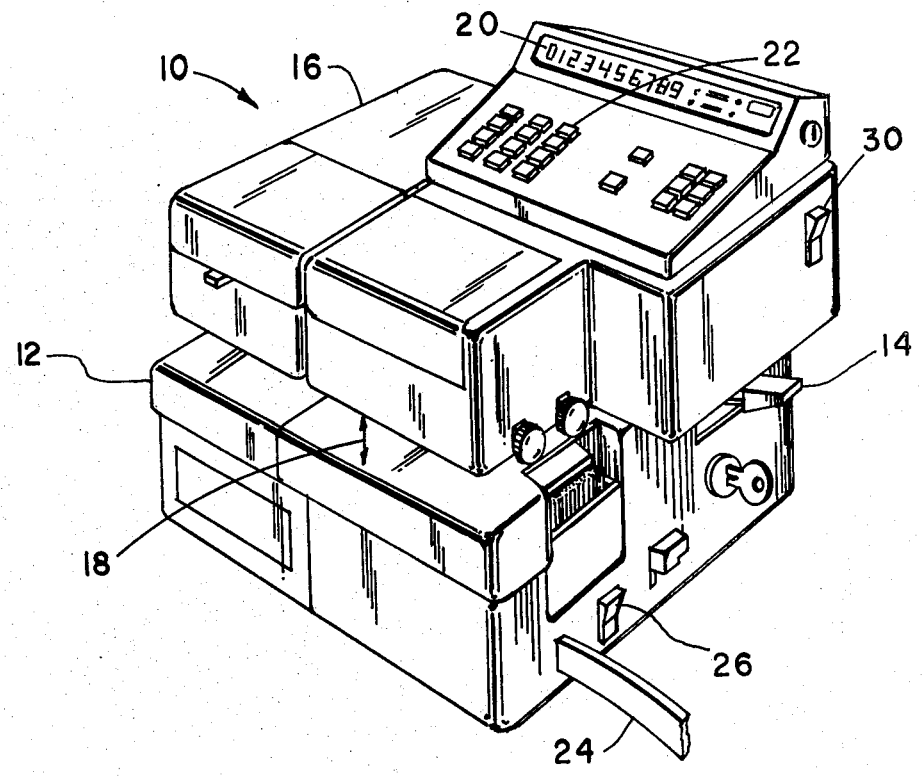
FIG. 1 is a perspective view of an electronic postage meter adapted to utilize the present invention.

Reference is now made to FIG. 1. An electronic postage meter 10 is removabily afixed to a postage meter base 12. The meter is locked into place by operation lever 14 associated with the base. When the meter is locked into place on the base 12, the base unit 12 is engaged in a manner to provide mechanical drive energy to the printing mechanism of the meter 10, to provide a communications channel via fiber optic links between the computing circuits of the base 12 and the meter 10, and finally, to provide electrical power to the postage meter unit to energize the postage meter computing circuits, keyboard, display and the value selection mechanism of the postage printing mechanism.

It should be recognized that the printing mechanism may either be a mechanical printing mechanism, an ink jet printing mechanism, a matrix pin printing mechanism, or any other suitable printing mechanism. The critical circuits within the meter 10 are shielded by a tamper proof housing 16. The housing 16 is of the type which prevents electromagnetic radiation, except as is coupled through a predetermined location in the bottom of the meter as shown in FIG. 2, from entering the electronic postage meter.

In the arrangement shown in FIG. 1, a slot 18 is provided between the postage meter 10 and the base 12 at the forward edge thereof, for receiving envelopes or the like and printing postage thereon. The postage meter is provided with a display panel 20, preferably an electronic display device, as well as a control panel or keyboard 22.

Power is applied to the meter base 12 via a AC power line 24. A switch on the base 26 is provided to energize the base when turned on. Another power switch 30 maybe provided on the meter unit itself to cause the postage meter power supply circuits to be rendered operable.

Figure 2:
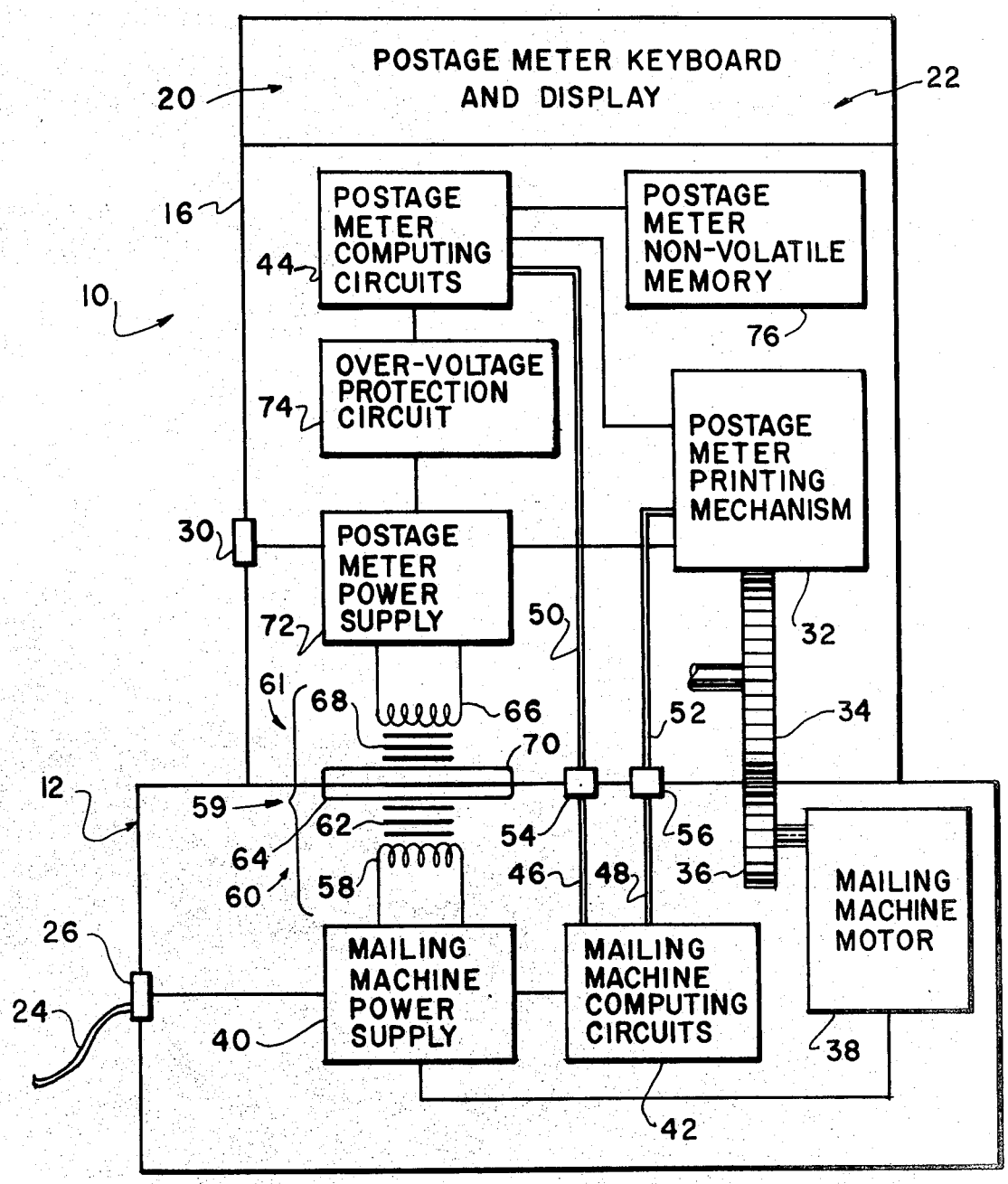
FIG. 2 is a block diagram of an electronic postage meter detachably connected to a mailing machine and employing magnetic energy coupled from the mailing machine to energize the electronic meter and emboding the present invention.

Reference is now made to FIG. 2. As previously noted, the postage meter 10 is detachably mounted to the postage meter mailing machine 12. When mounted, the mailing machine provides mechanical energy to postage meter printing mechanism 32 via a drive train including drive gear 34 in the postage meter 10 via a mating gear 36 in the mailing machine. The gear 36 is energized to rotate by a mailing machine motor 38 which is electrically powered from the mailing machine power supply 40. The gearing arrangement maybe similar to that shown in U.S. Pat. No. 2,934,009 for SHEET FEEDING AND TREATING. It should be expressly noted that if other then mechanical type of printing mechanism untilized, the mechanical coupling between the postage meter 10 and mailing machine 12 is not necessary. For example, if the postage meter printing mechanism 32 is an ink jet type printing mechanism or a pin printer type printing mechanism, no mechanical drive energy from the mailing mailing would be required.

The mailing machine 12 includes mailing machine computing circuits 42 adapted to control the operation of the mailing machine and to provide bi-directional communications with the postage meter computing circuits 44, and if desired, with the postage meter printing mechanism 32. The communications maybe in accordance with the serial communication echoplex techniques described in U.S. Pat. No. 4,301,507 for ELECTRONIC POSTAGE METER HAVING PLURAL COMPUTING SYSTEMS. The communication between the various components is achieved by the utilization of fiber optic cables 46, 48, 50, and 52. Fiber optic cables 50 and 46 are connected by a plug arrangement 54. In a like manner fiber optic cables 48 and 52 are connected by a plug arrangement 56. It should be noted that these plugs can be of the type which are self engaging when the postage meter 10 is mounted onto the mailing machine 12 and the locking lever 14 operated.

The mailing machine is energized when the power switch 26 on the mailing machine is turned on allowing the AC line voltage to be coupled to the mailing power supply 40. The mailing machine power supply 40 provides the electrical power to the mailing machine computing circuits 42 and to the mailing machine motor 38. Additionally, the mailing machine power supply 40 energizes the primary winding 58 of a portion of a transformer shown in brackets for the purpose of clarity and designated by the reference numeral 59. A first portion of the power supply 60 is located within the mailing machine 12. A second portion of the power supply 61 is located within the postage meter 10. When the postage meter 10 is secured to the mailing machine 12, the portions of the transformer in each section, cooperate to form a single operative transformer unit having a primary winding a secondary winding and a two part core.

The portion of the transformer 60 in the mailing machines includes the primary winding 58 energized by the mailing machine power supply 40, a first section of an iron coupling core 62 and a magnetic window 64 in the mailing machine casing 65. Thus, the casing 65 for the mailing machine 12 can be made of a nonmagnetizable medium while window 64 is made of a magnetizable medium and in conjuction with the iron core 62 provides a magnetic path which cooperates with a corresponding magnetic path in the postage meter unit 10.

The portion of the transformer 61 in the postage meter unit 10 includes a secondary winding 66 which is coupled via saturable core 68, to a mating magnetic window 70 in the case 16 of the postage meter 10. The magnetic window 70 functions in a manner similiar to the magnetic window 64.

It should be recogonized that if the two halves of the transformer 60 in the base and the meter are brought into close proximity the windows 64 and 70 can be non-magnetic and also electrically non-conductive an insulating material or a poor conductor. As an example, the window can be fabricated from a magnetizable medium with poor conductivity such as certain ferrte material. Or, if sufficiently thin the windows 64 and 70 can be fabricated from non-magnetizable insluating material such as glass or plastic.

With the meter 10 mounted on the mailing machine base 12, and energy applied to the mailing machine power supply 40, the primary winding 58 is energized. The magnetic flux generated by the primary winding 58 is coupled via the core 62, the window 64, the window 70, the core 68 to the secondary winding 66. This energizes the postage meter power supply 72. If the postage meter power switch 30 is turned on, the postage meter power supply 72, when thus energized, will likewise energize the postage meter printing mechanism 32 and, via an over-voltage protection circuit 74, the postage meter computing circuits 44. When this occurs, and, the postage meter keyboard and display are actuated, data stored in the postage meter non-volatile memory 76 is loaded into the postage meter computing circuit 44, and the meter 10 is in condition for operation.

It should be noted that the postage meter over-voltage protection circuit 74 may also include a detection circuit to detect when power from the postage meter power supply 72 is falling. When power fails or is turned off, the detection circuit triggers the postage meter computing circuits 44 to go into a power down routine and transfer the postage meter accounting information back to the postage meter non-volatile memory 76. A storage capacitor is provided in the postage meter power supply to provide a sufficient time to complete the information transfer.

When the meter 10 is removed from the postage meter base 12, magnetic energy can enter the meter 10 via the magnetic window 70 and, if sufficient in duration and magnitude cause the postage meter power supply 72 to be energized. However, providing a saturable core 68, excess amounts of magnetic energy cannot be coupled into the meter, because increasing magnetic energy will not increase the magnetic flux flowing through the saturable core 68. This protects the meter against damaged from excessive magnetic energy intentionally or inadvertently being directed against the magnetic window 70 in the postage meter casing 16. It should be recognized that other protections can be provided to avoid coupling excessive energy into the meter such as the utilization of a very high impedance electric resistance, and the suitable design of the magnetic circuit. Moreover, protection can be included in the postage meter computing program such that if the postage meter power supply is energized and deenergized more than a predetermined number of times within a predetermined time period the meter can be caused to become inoperative. Additionally, a code known only to authorized users can be employed to enable the meter for operation can also be required to be inputed via the postage meter keyboard 22 only when the meter is on the base and an enabling command issued by the mailing machine computing circuits 42.

The size of the magnetic circuit can be reduced by utilizing a higher frequency than the 60 or 50 hertz rate commonly associated with AC line power. By increasing the frequency at whfch the primary winding 58 is energized to as high as 100 kilohertz, which is commonly associated with circuit switching power supplies, the size and cost of the magnetic circuit can be reduced. The particular operating frequency is a matter of design choice in accordance with the particular design of the mailing machine power supply 40 and the particular design of the postage meter power supply 72 as well as the transformer 60.

Figure 3:
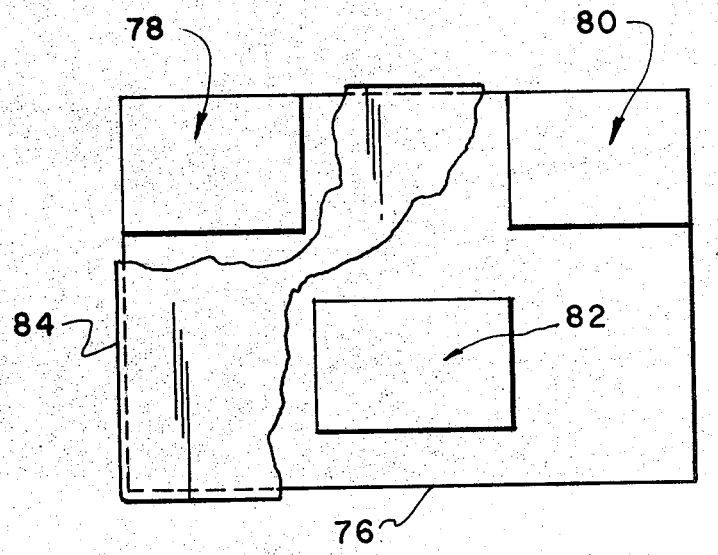
FIG. 3 is a partial memory map of the non-volatile memory shown in FIG. 2 depicting the physical placement in memory of various critical accounting information in a manner to enable the data to be reconstructed by a scanning electron miroscope if the non-volatile memory becomes electrically damaged.

Reference is now made to FIG. 3. The non-volatile memory 76 of the postage meter, as previously noted, provides for the storage of critical accounting information when the postage meter 10 is not energized. This includes information concerning the ascending register of the postage meter, the descending register of the postage meter and other data such as the total number of cycles operated by meter, and codes designating any particular operating difficulties with the meter. This data which for the purposes of the present application is considered to be critical accounting information is written into predetermined physical locations of memory. The locations are desirably surface locations easily physically accessed by, for example, the removal of a detachable cover 84. There are a plurality of such locations 78, 80 and 82. These locations are selected to be both physically accessible and physically locatable areas of the non-volatile memory 76. Thus, the first location for the critical accounting data 78 is located at one corner of the non-volatile memory while the second location 80 is at another corner of the non-volatile memory. The third location 82 is shown as being intermediate to corners of the memory.

If the meter memory should electrically fail for any reason, by having a plurality of predefined physically accessible memory locations storing the critical accounting information, the information can be reconstructed even though the memory is electrically inoperative. Accordingly, an inoperative non-volatile memory 76 is physically removed from the postage meter unit 10 and the predetermined locations 78, 80 and 82 are examined with a scanning electron microscope to determine the orientation of predetermined memory areas to reconstruct the bit pattern for the critical accounting data. In this way, by reading one location, the data can be reconstructed. By comparing the reconstructed data from the other of the plurality of locations, the level of assurance as to the accuracy as to the reconstructed data is greatly increased.

While the present invention has been disclosed and described with reference to a single embodiment thereof, it will be apparent that variations and modification may be made therein, and it is intended in the following claims to cover each such variation and modification as falls within the true spirit and scope of the invention.

What is claimed is:

1. A postage meter of the type including a printing means for printing postage, comprising:

computing means coupled to said printing means for accounting for postage printed by said printing means;

power supply means coupled to said computing means for energizing said computing means to operate;

said power supply means including a winding for energizing said power supply means when magnetic flux is caused to pass through said winding;

said power supply means further including a magnetic circuit for coupling magnetic flux to said winding; and housing means enclosing said postage meter power supply means, said postage meter computing means, and said postage meter printing means, said housing means including a portion for allowing the passage of magnetic energy into the interior thereof to energize said magnetic circuit.

2. A postage meter as defined in claim 1 wherein said magnetic circuit includes a saturable magnetic circuit means adapted to saturate when the magnetic energy exceeds a predetermined level.

3. A postage meter as defined in claim 1 wherein said housing means portion is fabricated from a magentizable medium and the remainder of said housing is fabricated from a nonmagnetizable medium.

4. A postage meter as defined in claim 1 including a second portion in said housing for accommodating optical coupling into the interior of said housing.

5. A postage meter as defined in claim 4 wherein said second portion optical coupling is connected by an optical link to said postage meter computing means.

6. A postage meter system, comprising:

a first unit with first housing means and a second unit with second housing means;

said first unit housing enclosing a printing means and a computing means said computing means operably coupled to said printing means for accounting for postage printed by said printing means;

said first housing further enclosing a power supply means coupled to energize said computing means and energized by magnetic energy generated in said second unit and coupled into the interior of said first unit housing;

said second unit including a power supply means including means for generating magnetic energy; and means coupling said magnetic energy generated in said second unit to said power supply means in said first unit.

7. A postage meter mailing machine for engaging a postage meter unit comprising;

housing means including a first portion for passing magnetic energy;

power supply means for energizing said postage meter mailing machine;

said power supply means generating magnetic energy; and magnetic circuit means cooperating with said power supply means to couple said magnetic energy to said housing first portion whereby a postage meter unit when mounted on said postage meter mailing machine will be energized by magnetic energy passing through said housing first portion.

8. A postage meter of the type including a printing means for printing postage, comprising:

computing means coupled to said printing means for accounting for postage printed by said printing means;

power supply means coupled to said computing means for energizing said computing means to operate;

said power supply means including a winding for energizing said power supply means when magnetic flux is caused to pass through said winding;

said power supply means further including a magnetic circuit for coupling magnetic flux to said winding said magnetic circuit includes a saturable magnetic circuit means adapted to saturate when the magnetic energy exceeds a predetermined level;

housing means enclosing said postage meter power supply means, said postage meter computing means, and said postage meter printing means, said housing means including a portion for allowing the passage of magnetic energy into the interior thereof to energize said magnetic circuit; and, said computing means programmed to render said accounting circuit inoperative when said power supply means is energized and de-energized more than a number of times specified within said program within a time period specified within such program.

9. A postage meter as defined in claim 8 wherein said housing means portion is fabricated from a magentizable medium and the remainder of said housing is fabricated from a non-magnetizable medium.

* * * * *